US005999142A

United States Patent [19]

Jang

[11] Patent Number: 5,999,142

[45] Date of Patent: Dec. 7, 1999

[54] ANTENNA FOR PORTABLE RADIO SETS HAVING REFLECTING PLATE

[75] Inventor: Chang-Weon Jang, Gumi, Rep. of Korea

[73] Assignee: SamSung Electronics Co., Ltd., Kyungki-do, Rep. of Korea

[21] Appl. No.: 08/652,108

[22] Filed: May 23, 1996

[30] Foreign Application Priority Data

May 24, 1995 [KR] Rep. of Korea ..... 95-13054

[51] Int. Cl.[6] ..... H01Q 1/24

[52] U.S. Cl. ..... 343/834; 343/702; 343/841; 343/873; 343/895

[58] Field of Search ..... 343/873, 702, 343/841, 900, 895, 834; H01Q 1/24

[56] References Cited

U.S. PATENT DOCUMENTS

| | | | |
|---|---|---|---|
| 4,868,576 | 9/1989 | Johnson, Jr. | 343/702 |
| 5,335,366 | 8/1994 | Daniels | 455/89 |
| 5,338,896 | 8/1994 | Danforth | 174/35 R |
| 5,367,309 | 11/1994 | Tashjian | 343/702 |
| 5,373,304 | 12/1994 | Nolan et al. | 343/841 |
| 5,444,866 | 8/1995 | Cykiert | 455/89 |
| 5,479,178 | 12/1995 | Ha | 343/702 |
| 5,493,704 | 2/1996 | Grangeat et al. | 455/90 |
| 5,507,012 | 4/1996 | Luxon et al. | 455/89 |

*Primary Examiner*—Michael C. Wimer
*Attorney, Agent, or Firm*—Robert E. Bushell, Esq.

[57] ABSTRACT

A first antenna configuration contemplates a body housing and an antenna cap positioned at a top portion of the body housing. A helical winding is disposed within the antenna cap for radiating electromagnetic waves. A reflecting plate is installed within the antenna cap at a spaced-apart distance from the helical winding for reflecting the electromagnetic waves in a direction away from a user. Polyacetal material is disposed within the antenna cap for supporting the reflecting plate.

13 Claims, 4 Drawing Sheets

ANTENNA FOR PORTABLE RADIO SETS HAVING REFLECTING PLATE

CROSS-REFERENCE TO RELATED APPLICATIONS

This application makes reference to, incorporates the same herein, and claims all benefits accruing under 35 U.S.C. §119 arising from an application for *Antenna For Portable Radio Sets Having Reflecting Plate* earlier filed in the Korean Industrial Property Office on May 24, 1995 and there duly assigned Ser. No. 13054/1995.

BACKGROUND OF THE INVENTION

The present invention relates to an antenna for portable radio sets, and more particularly, to an antenna for portable radio sets in which a reflecting plate is provided for reflecting radiated waves.

In the prior art, a helical antenna and a rod antenna have been combined to form a unitary antenna structure for a portable radio set. With this construction, it is possible to separately operate the helical antenna when the rod antenna is retracted, or to separately operate the rod antenna when the rod antenna is extended.

One prior art reference having both a helical and rod antenna is disclosed in U.S. Pat. No. 4,868,576 entitled *Extendable Antenna for Portable Cellular Telephones with Ground Radiator* issued to Johnson. In Johnson '576, the rod antenna is positioned on a top portion of a housing and includes two detents which engage tangs of an antenna housing when retracted and extended. The tangs snap into the detents, thereby providing the operator with tactile feedback indicating whether the antenna is fully retracted or extended. The rod antenna slides into and out of the antenna housing, through a helical coil. The rod antenna also includes a protective top end cap, a top portion with the detent, a middle portion with a coil, a bottom portion with the detent and a bottom end cap. The rod antenna is comprised of a flexible plastic material, such as "Delryn" with the mid-portion coil comprised of silver-plated beryllium-copper wire having a diameter of 13 mils ($^{13}/_{1000}$th of an inch). Therefore, when the rod antenna is retracted, the unit operates as a helical antenna. When extended, the rod antenna is capacitively coupled to the helical antenna. As a result, the configuration is operated in accordance with the length of the rod antenna.

Consequently, the conventional antenna configuration described above distributes centralized radiating power (maximally, 0.6 W) to the helical antenna or the rod antenna. Therefore, a problem results in that harmful electromagnetic waves may be applied to a user's head.

SUMMARY OF THE INVENTION

Accordingly, it is an object of the present invention to provide an improved antenna configuration for a portable radio set.

It is another object to provide an antenna configuration that reduces the application of harmful electromagnetic waves to a user's head.

It is still another object to provide an antenna configuration in which a reflecting plate is provided for reflecting radiating power.

It is yet another object to provide an antenna configuration in which a reflecting plate is provided for minimizing the adverse influence of electromagnetic waves on a user's body.

These and other objects can be achieved according to the principles of the present invention with a first antenna configuration contemplating a body housing and an antenna cap positioned at a top portion of the body housing. A helical winding is disposed within the antenna cap for radiating electromagnetic waves. A reflecting plate is installed within the antenna cap at a spaced-apart distance from the helical winding for reflecting the electromagnetic waves in a direction away from a user. Polyacetal material is disposed within the antenna cap for supporting the reflecting plate.

These and other objects can also be achieved with a second antenna configuration contemplating a body housing and an antenna cap positioned at a top portion of the body housing. A housing connector has a cylindrical hole formed therein, and a top portion that ajoins a bottom portion of the antenna cap. A polyacetal rod extends through the cylindrical hole and an interior portion of the antenna cap. A knob is positioned at a top end of the polyacetal rod, and a stopper is positioned at a bottom end of the polyacetal rod. A core wire is positioned within an interior portion of the polyacetal rod for radiating electromagnetic waves. A bottom end of the core wire is connected to the stopper. A reflecting plate is installed within the interior portion of the polyacetal rod for reflecting the electromagnetic waves in a direction away from a user. Polyacetal material is disposed within the interior portion of the polyacetal rod for supporting the reflecting plate at a spaced-apart distance from the core wire.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar elements components, wherein.

DETAILED DESCRIPTION OF THE INVENTION

Figure 1:
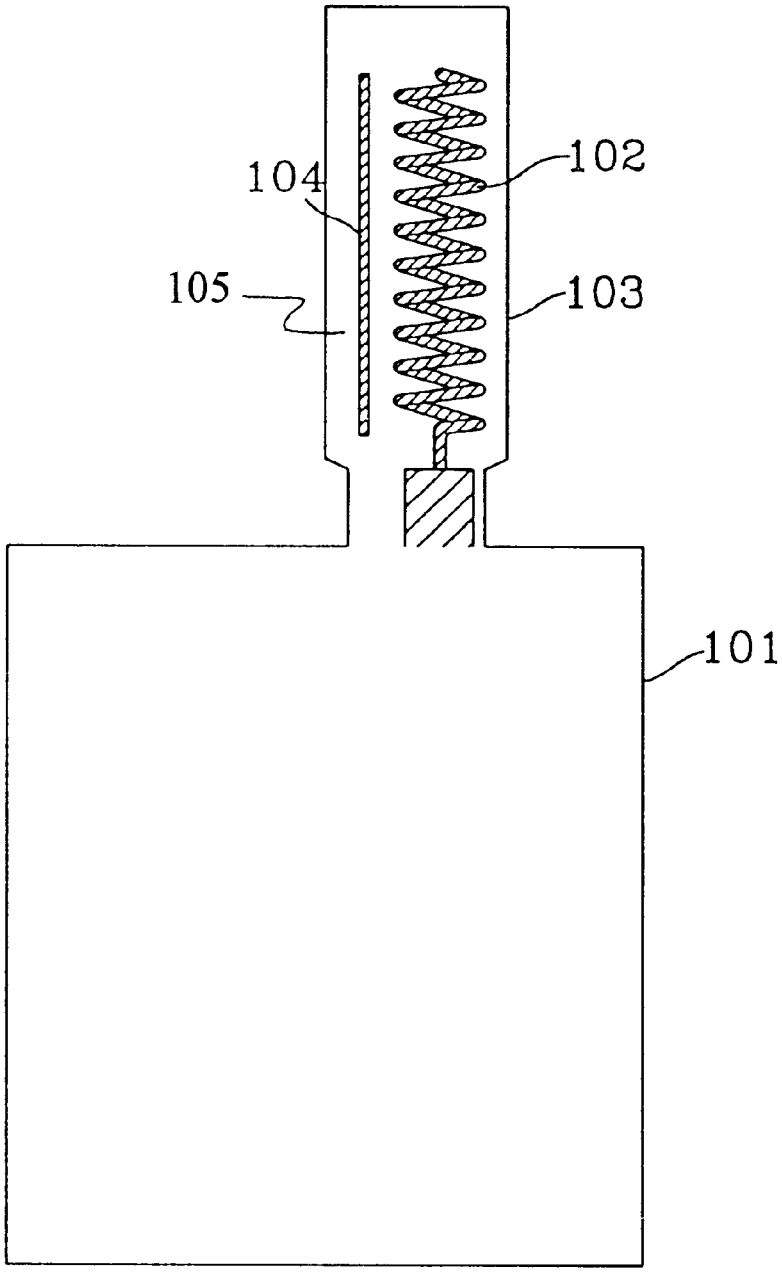
FIG. 1 illustrates the construction of a helical antenna in which a reflecting plate is provided according to the principles of the present invention.

Turning now to the drawings and referring to FIG. 1, the construction of a helical antenna having a reflecting plate according to the principles of the present invention is illustrated. In FIG. 1, an antenna cap 103 is provided at a top portion of a body housing 101, and a helical winding 102 for radiating electromagnetic waves is disposed within antenna cap 103. Antenna cap 103 shields helical winding 102 from physical contact. A reflecting plate 104 is installed within antenna cap 103 and is spaced-apart from helical winding 102 by a given distance to reduce the adverse influence of the electromagnetic waves on a user's body. Reflecting plate 104 is preferably flat, rather than curved, and is composed of a light material, such as aluminium. Antenna cap 103 is filled with a polyacetal material 105 that suspends reflecting plate 104 within the interior of antenna cap 103.

Figure 2:
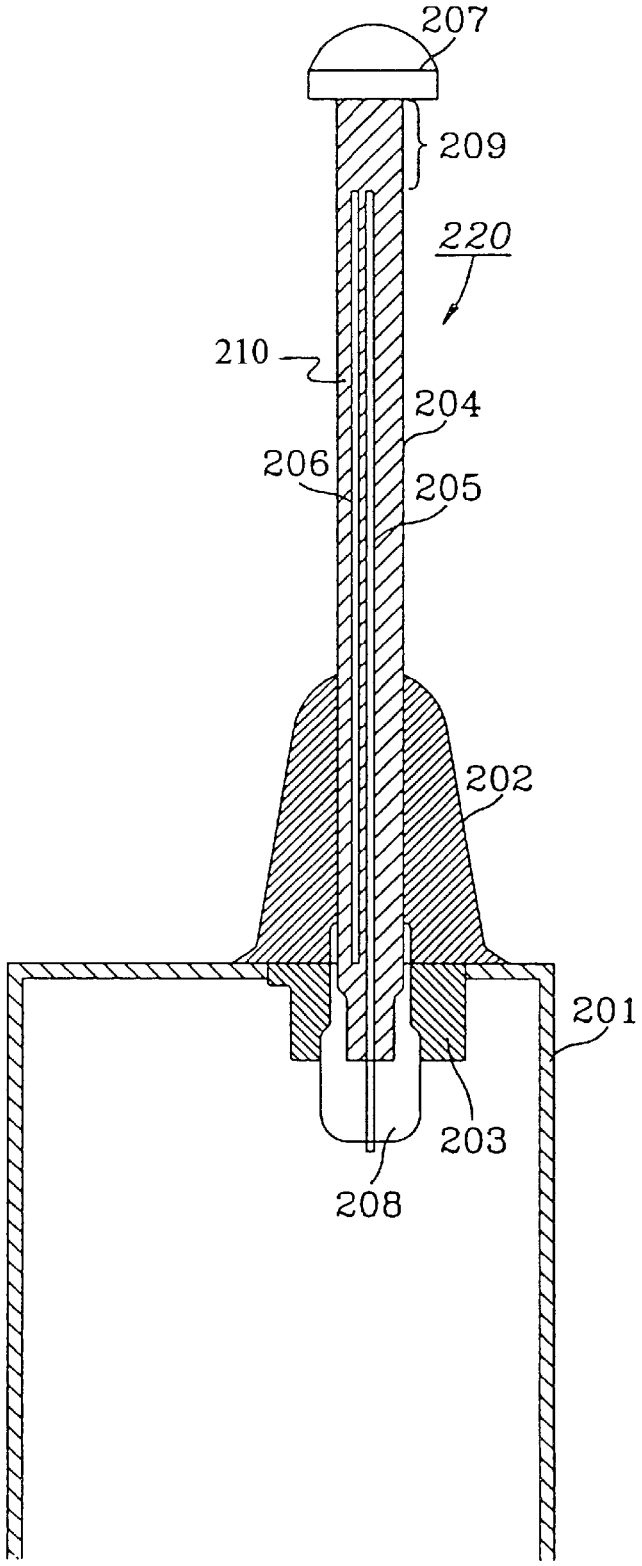
FIG. 2 illustrates the construction of a rod antenna in which a reflecting plate is provided according to the principles of the present invention.

FIG. 2 illustrates the construction of a rod antenna in which a reflecting plate is provided according to the principles of the present invention. In FIG. 2, a rod antenna 220 includes a reflecting plate 206 for reducing the adverse influence of electromagnetic waves on a user's body. An antenna cap 202 is provided at a top portion of a body housing 201, and a housing connector 203 having a cylindrical hole formed therein is positioned within the top portion of body housing 201 and engages a bottom portion of antenna cap 202. A knob 207 is formed at a top end of a polyacetal rod 204 having an antenna insertion hole formed in its interior. Polyacetal rod 204 is inserted into the cylindrical hole formed in housing connector 203 through a hollow interior of antenna cap 202. A stopper 208 is provided at a bottom end of polyacetal rod 204, and a rod antenna core wire 205 having a bottom portion fixed to stopper 208 is positioned within the antenna insertion hole of polyacetal rod 204 for radiating electromagnetic waves. Polyacetal rod 204 shields antenna core wire from physical contact. An insulator 209 is formed at a top portion of polyacetal rod 204. Reflecting plate 206 is installed within the antenna insertion hole of polyacetal rod 204, and is spaced-apart from rod antenna core wire 205 by a given distance. In this configuration, reflecting plate 206, which is preferably flat and composed of a light material such as aluminium, is substantially parallel to rod antenna core wire 205. Accordingly, the application of harmful electromagnetic waves to a user's head is reduced. Polyacetal rod 204 is filled with a polyacetal material 210 that suspends reflecting plate 206 within the interior of polyacetal rod 204.

Figure 3:
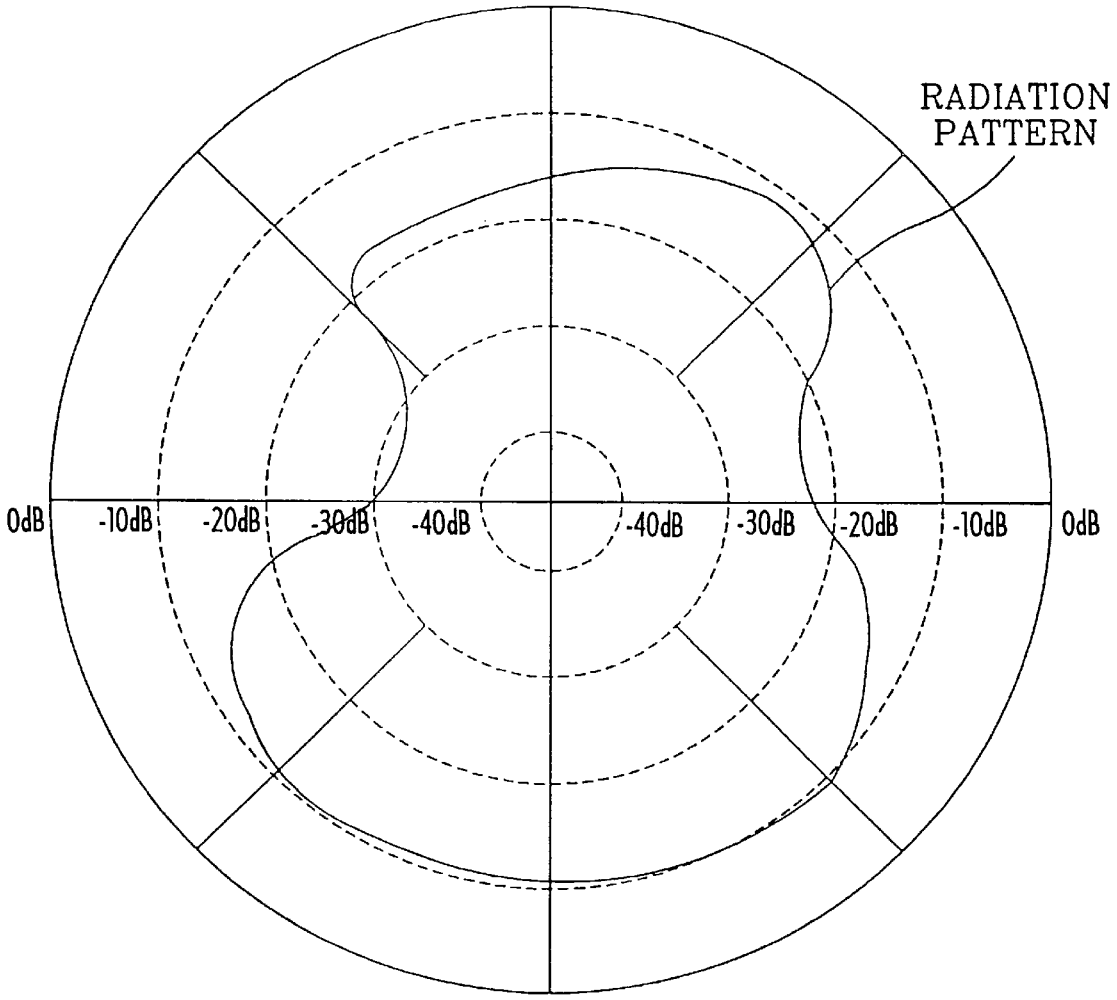
Fig. 3 (PRIOR ART)
FIG. 3 illustrates a radiating power distribution pattern for a conventional antenna.
Figure 4:
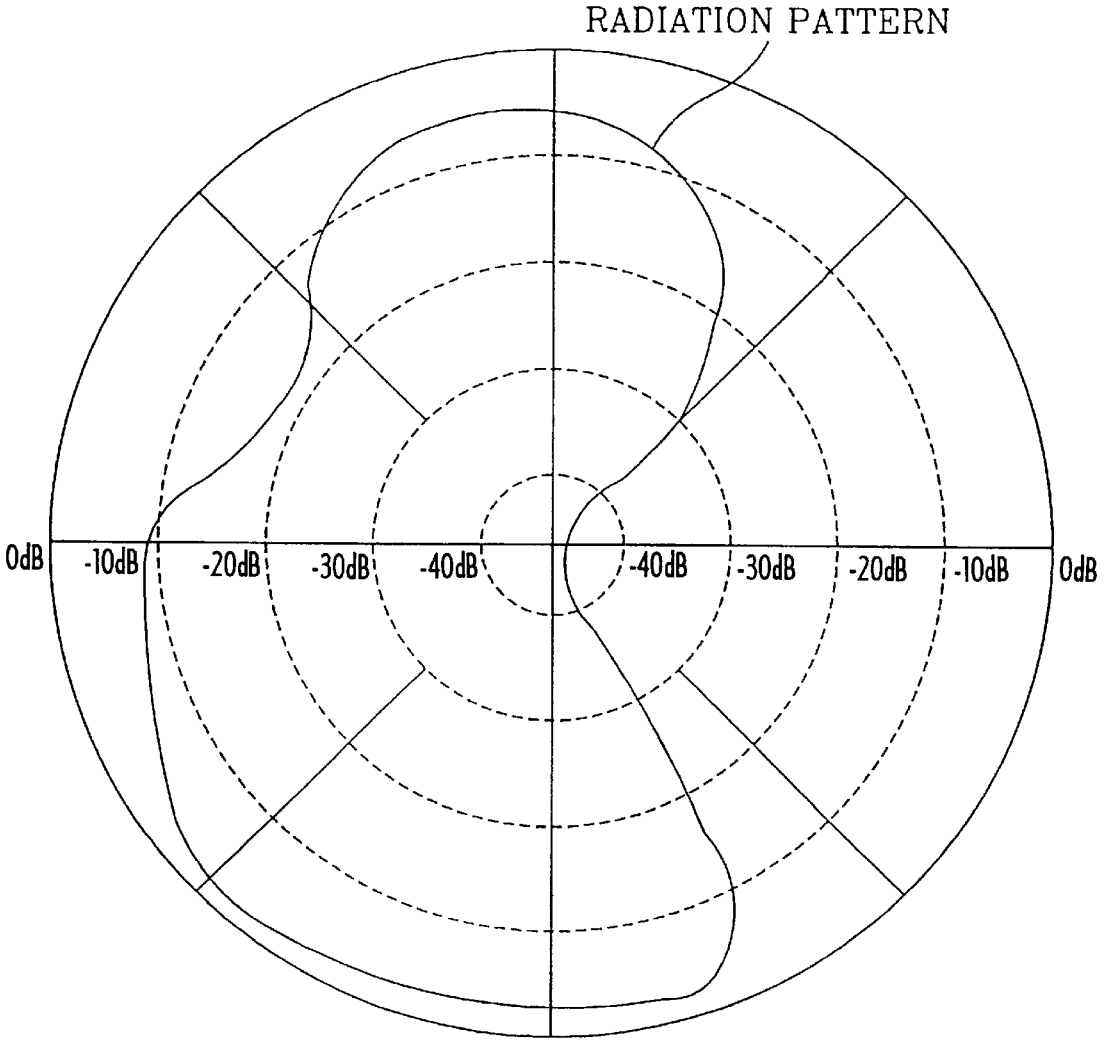
FIG. 4 illustrates a radiating power distribution pattern for the antennas having a reflecting plate according to the principles of the present invention.

FIG. 3 illustrates a radiating power distribution pattern for a conventional antenna, and FIG. 4 illustrates a radiating power distribution pattern for the antenna having a reflecting plate according to the principles of the present invention.

A preferred embodiment of the present invention will now be explained in detail with reference to FIGS. 1 through 4.

In this preferred embodiment, the antenna configuration constructed according to the principles of the present invention can be used in portable radio sets for transmitting and receiving radio frequency signals having frequencies between exemplary bandwidths of 824–849 MHz and 869–894 MHz.

As shown in the drawings, the helical antenna of FIG. 1 is comprised of helical winding 102 and reflecting plate 104. Helical winding 102 is preferably comprised of silver-plated piano wire. Moreover, since the helical antenna is constructed with helical winding 102, its physical length is considerably shorter than that of rod antenna 220. The actual electrical length of the helical antenna, however, becomes shorter due to the use of antenna cap 103. The radiating power distribution pattern for the helical antenna using helical winding 103 without reflecting plate 104 is shown in FIG. 3. This configuration results in a problem in that harmful electromagnetic waves may be applied to a user's head. To solve this problem, reflecting plate 104 is installed within antenna cap 103, and is spaced-apart from helical winding 102 by a given distance. Accordingly, in portable radio sets utilizing the principles of the present invention, electromagnetic waves radiated from helical winding 102 are reflected by reflecting plate 104. The radiating power distribution pattern for this configuration is shown in FIG. 4.

In FIG. 2, rod antenna 220 includes a top portion having knob 207 and insulator 209, and a bottom portion having stopper 208. Antenna core wire 205, which extends from stopper 208 to a bottom portion of insulator 209, is surrounded by polyacetal rod 204 which provides good restoring force. Antenna core wire 205 is preferably composed of silver-plated copper wire, piano wire, super elastic nickel-titanium wire (i.e., shape-memory alloy) having good original shape restoring force, or the like. The electrical length of antenna core wire 205 depends upon the vertical length of body housing 201, and thus varies from a quarter-wavelength to a half-wavelength (i.e., about 87 to 174 mm at 860 MHz).

During transmission, rod antenna 220 radiates electromagnetic waves which over time can be harmful to the user. Consequently, reflecting plate 206 is installed within polyacetal rod 204 at a spaced-apart distance from antenna core wire 205. Accordingly, the electromagnetic waves radiated from rod antenna 220 during transmission are reflected by reflecting plate 204, and the harmful influence of the electromagnetic waves on the user is substantially reduced. The quality of the material used for reflecting plates 104 and 206 is the same as that of parabola or horn antennas. The radiating power distribution pattern for this configuration is also represented in FIG. 4.

As is apparent from the foregoing, the present invention provides an advantage in that a reflecting plate is installed in a helical or rod antenna so as to reflect harmful electromagnetic waves away from the user's body.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. An antenna configuration, comprising:

a body housing;

radiating means extending from a top portion of said body housing for radiating electromagnetic waves;

shielding means disposed about said radiating means for shielding said radiating means from physical contact;

reflecting means disposed within said shielding means for reflecting said electromagnetic waves in a direction away from a user; and polyacetal material disposed within said shielding means for supporting said reflecting means at a spaced-apart distance away from said radiating means.

2. The antenna configuration as claimed in claim 1, wherein said radiating means comprises a core wire.

3. The antenna configuration as claimed in claim 2, wherein said core wire comprises one of silver-plated copper wire, piano wire and nickel-titanium wire.

4. The antenna configuration as claimed in claim 2, wherein said shielding means comprises a polyacetal rod.

5. The antenna configuration as claimed in claim 1, wherein said radiating means comprises a helical winding.

6. The antenna configuration as claimed in claim 5, wherein said shielding means comprises an antenna cap.

7. The antenna configuration as claimed in claim 1, wherein said reflecting means comprises a flat aluminium plate.

8. An antenna configuration, comprising;

a body housing, an antenna cap positioned at a top portion of said body housing;

a helical winding disposed within said antenna cap for radiating electromagactic waves;

a reflecting plate installed within said antenna cap at a spaced-apart distance from said helical winding for reflecting said electromagnetic waves in a direction away from a user; and polyacetal material, disposed within said antenna cap supporting said reflecting plate at a spaced-apart distance from said helical winding.

9. The antenna configuration as claimed in claim 8, wherein said reflecting plate is flat.

10. The antenna configuration as claimed in claim 9, wherein the polyacetal material is disposed within said antenna cap for supporting said reflecting plate.

11. An antenna configuration, comprising:

a body housing;

an antenna cap positioned at a top portion of said body housing;

a housing connector having a cylindrical hole formed therein, and a top portion adjoining a bottom portion of said antenna cap;

a polyacetal rod extending through said cylindrical hole and an interior portion of said antenna cap;

a knob positioned at a top end of said polyacetal rod;

a stopper positioned at a bottom end of said polyacetal rod;

a core wire positioned within an interior portion of said polyacetal rod for radiating electromagnetic waves, said core wire having a bottom end connected to said stopper;

a reflecting plate installed within said interior portion of said polyacetal rod for reflecting said electromagnetic waves in a direction away from a user; and polyacetal material disposed within said interior portion of said polyacetal rod for supporting said reflecting plate at a spaced-apart distance from said core wire.

12. The antenna configuration as claimed in claim 11, wherein said reflecting plate is flat.

13. The antenna configuration as claimed in claim 11, wherein said core wire comprises one of silver-plated copper wire, piano wire and nickel-titanium wire.

* * * * *